US005418547A

United States Patent [19]

Mizukata et al.

[11] Patent Number: 5,418,547

[45] Date of Patent: May 23, 1995

[54] DRIVING CIRCUIT FOR DISPLAY DEVICES

[75] Inventors: Katsuya Mizukata, Shijonawate; Takaaki Iemoto, Takaichi, both of Japan

[73] Assignee: Sharp Kabushiki Kaisha, Osaka, Japan

[21] Appl. No.: 199,465

[22] Filed: Feb. 22, 1994

[30] Foreign Application Priority Data

Feb. 22, 1993 [JP] Japan ..... 5-032014

[51] Int. Cl.[6] ..... G09G 3/36

[52] U.S. Cl. ..... 345/98; 345/88; 345/100

[58] Field of Search ..... 345/88, 94, 98, 100, 345/208; 359/55

[56] References Cited

U.S. PATENT DOCUMENTS 5,166,670 11/1992 Takeda et al. ..... 345/98

FOREIGN PATENT DOCUMENTS 3-158895 7/1991 Japan .

4-365288 12/1992 Japan .

*Primary Examiner*—Ulysses Weldon

*Assistant Examiner*—Matthew Luu

*Attorney, Agent, or Firm*—David G. Conlin; Robert F. O'Connell; Kevin J. Fournier

[57] ABSTRACT

A matrix-type display device capable of effecting color-displaying is constructed such that the mode of sampling neighboring RGB data can be optionally selected from two modes, e.g., three-point successive sampling mode and three-point simultaneous sampling mode. In the case of the three-point successive sampling mode, since pulses are generated successively so that each pulse is shifted by one-dot term $\tau$ from one another, the pulse terms of sampling pulses are shifted by one-dot term $\tau$ from one another. Accordingly, pixel signals supplied to respective three neighboring RGB pixels are shifted by one-pixel equivalent. On the other hand, in the case of the three-point simultaneous sampling, generated pulses all stay at high level at any time. Therefore, the pulse terms of sampling pulses are made coincident, so that pixel signals supplied to respective three neighboring RGB pixels are of data on an identical point.

1 Claim, 8 Drawing Sheets

DRIVING CIRCUIT FOR DISPLAY DEVICES

BACKGROUND OF THE INVENTION

1. Field of the Invention

The present invention relates generally to a driving circuit for display devices such as liquid crystal display devices, electro-luminescence display devices, plasma displays and the like, in which a number of pixel units each of which is made up of three neighboring pixels presenting red color (to be referred to as 'R'), green color (to be referred to as 'G') and blue color (to be referred to as 'B'), respectively, are arranged matrix-wise so that all the intersection between row-electrodes and column-electrodes are occupied by the pixels. The present invention relates in particular to a driving circuit for the column-electrodes.

2. Description of the Prior Art

For matrix type display devices, it is impossible to display a certain color point in a color picture by a single pixel of a mixed color of the three RGB mixing colors. Therefore, display of a single point in the color picture is effected as a composed color of three pixels, i.e., R-presenting pixel, G-presenting pixel and B-presenting pixel by adjusting intensity for each of RGB colors. For this reason, displaying a certain color point on a screen requires a wider area, i.e., three pixel area for RGB colors in place of a single dot. Therefore, the picture on the screen inevitably becomes rough. To deal with this, it is necessary to improve the fineness of the display pixel matrix so that the area occupied by three pixels on the display screen is reduced to the size as small as a single dot, or if it is impossible to improve the fineness of the display pixel matrix, it is necessary to shift the timings at which pixel signals to be respectively supplied to pixels presenting RGB colors are sampled from respective RGB video signals so that each of the sampled pixel signals may exactly agree with the display position of the pixel on the screen.

Now, description will be made by giving an example of a thin film transistor (TFT) liquid crystal display device with reference to the drawings. FIG. 1 is a block circuit diagram showing a conceptual basic structure of a TFT-employed liquid crystal display device having a display panel 6 in which pixels are provided in matrix-arrangement. With regard to each of TFTs 5, the source S is connected to a column-electrode 2 and the drain D is connected to a pixel electrode 4 whereas the gate G is connected to a row-electrode 1.

A row-electrode driving circuit 7 applies ON-state voltage to a first row-electrode 1*a* and then applies it to the following row-electrodes 1, one after one. At this time, the ON-state voltage is provided simultaneously for all the gates G of TFTs 5 which are connected to a common row-electrode 1. As a result, all the TFTs 5 connected to the same row-electrode 1 are simultaneously activated or deactivated as analog switches. A column-electrode driving circuit 8 effects samplings from video signals VR, VG and VB, during respective sampling terms ($=\tau$) which are determined based on a start pulse SP and a clock signal CKA or CKB given from the outside. Thus sampled pixel signals Sr1, Sg1, Sb1, Sr2 . . . contained in the respective one-dot terms ($=\tau$) are provided to corresponding column-electrodes 2r1, 2g1, 2b1, 2r2 . . . each being connected to a pixel presenting R, G or B.

When TFTs 5 on the row-electrode 1*a* are activated, the channel between the source S and the drain D is made conductive for all the TFTs 5. As a result, the pixel signals Sr1, Sg1, Sb1 and Sr2 . . . are given through column-electrodes 2r1, 2g1, 2b1, 2r2 . . . to respective pixel electrodes 4 of pixels 3R, 3G, 3B, 3R' . . . and held thereby.

Pixels 3 are arranged in all the intersections between row-electrodes 1 and column-electrodes 2 and each pixel 3 is formed of a transparent pixel electrode 4 and a thin film transistor (to be referred to as "TFT" hereinafter) 5. Pixels 3R, 3G and 3B are provided with filters R, G and B (not shown), respectively. Transmittance of liquid crystal (not shown) at each pixel varies in accordance with the pixel signal, e.g., Sr1, Sb1 or Sb1, . . . , applied to the pixel electrode 4. Each of these pixels is adapted to present a predetermined color having adjusted intensity by the liquid crystal with the help of white light emitted from a back light (not shown) passing therethrough.

Here, pixels 3R, 3G and 3B present R, G and B colors, respectively so that 'R', 'G' and 'B' are denoted in the figure. Other pixels are also designated in the same manner. In this configuration, a mixing color to be displayed by a dot is displayed by three neighboring pixels 3R, 3G and 3B which present the three primary colors R, G and B, respectively and the user senses a composed color from these three pixels. In this case, since each position of the display pixel differs by a length L from the neighboring pixels, the pixel signals Sr1, Sg1 and Sb1 to be given to those pixels must be shifted from one another by one-pixel length. Accordingly, sampling timings of these signals must be shifted from one another by one-dot term ($\tau$). The sampling method in which the data for neighboring three pixels are sampled individually and successively is called as three-point successive sampling method and is used widely.

Referring now to the drawings, the three-point successive sampling method will be described. FIGS. 2 and 6 respectively show a block circuit diagram of a column-electrode driving circuit 8 and a timing chart used in the case. FIGS. 4 and 5 respectively show a sampling circuit 20 and an output buffer circuit 21. In FIG. 2, the same components as in described in FIG. 1 are denoted with the same reference numerals and detailed description for those is omitted. Sampling circuits 20*a*, 20*b*, 20*c*, 20*d*, 20*e*, 20*f*, . . . all have an identical circuit structure with that of the sampling circuit 20 shown in FIG. 4. Output buffer circuits 21*a*, 21*b*, 21*c*, 21*d*, 21*e*, 21*f*, . . . all have an identical circuit structure with that of the output buffer circuit 21 shown in FIG. 5.

In FIG. 4, a sampling pulse A supplied to the gate G of a TFT 23 via a terminal 25 represents one of sampling pulses Ar1, Ag1, Ab1, Ar2, Ag2, Ab2, . . . shown in FIG. 2. A video signal V supplied to a terminal 26 represents one of video signals VR, VG and VB shown in FIG. 2. If TFT 23 serving as an analog switch is turned on by the sampling pulse A, the channel between the source S and the drain D becomes conductive and consequently, the video signal V is held by a sampling condenser 24. The sampling circuit 20 outputs the held video signal V as a pixel signal B via a terminal 27 to a next step, i.e., to a terminal 32 of an output buffer circuit 21 (FIG. 5). Here, the pixel signal B represents one of pixel signals Br1, Bg1, Bb1, Br2, Bg2, Bb2, . . . shown in FIG. 2. It should be noted that TFT 23 may be replaced with another element as long as it works as an analog switch.

In FIG. 5, a hold pulse OE which is given to the gate G of a TFT 28 via a terminal 31 is to be provided from a terminal 19 shown in FIG. 2 after the completion of all the sampling operations for one-line period. When the hold pulse OE activates TFT 28 serving as an analog switch, the channel between the source S and drain D is made conductive, and consequently, the pixel signal B supplied to the terminal 32 is held by a hold condenser 29 and amplified by an amplifier 30. The thus amplified signal is outputted as a pixel signal S via a terminal 33 to a next step, i.e., to one of the column-electrodes 2. Here, the pixel signal S represents one of pixel signals Sr1, Sg1, Sb1, Sr2, Sg2, Sb2, . . . . It should be noted that TFT 28 may be replaced with another element as long as it has a function of an analog switch.

In FIG. 2, provided to terminals 12, 13 and 14 are video signals VR, VG and VB, respectively. Terminal 9 is supplied with a start pulse SP shown in FIG. 6(101) and terminal 10 is supplied with a clock signal CKA pulsing periodically at intervals of one-dot term ($\tau$) as shown in FIG. 6(102). A pulse width determining circuit 22 receives the start pulse SP to generate a pulse SPA having a predetermined pulse width shown in FIG. 6(103).

D-flip flops DA1, DA2, DA3, DA4, DA5, DA6, . . . sample pulses SPA, QA1, QA2, QA3, QA4, QA5, . . . , respectively, when the clock signal CKA given to terminals CKs rises and generate pulses QA1, QA2, QA3, QA4, QA5, QA6, . . . , respectively, as shown in FIGS. 6(104), (105), (106), (107), (108), and (109), each of which is delayed by $\tau$ from the pulse immediately before. The thus generated signals are provided to sample hold circuits 20*a*, 20*b*, 20*c*, 20*d*, 20*e*, 20*f*, . . . , respectively.

For instance, since pulses QA1, QA2 and QA3 have different pulse terms shifted by $\tau$ from one to the next, pixel signals Br1, Bg1 and Bb1 sampled respectively from video signals VR, VG and VB at the rise of pulse QA1, QA2 or QA3, will have video data on different positions shifted by one pixel. Similarly, pixel signals Br1, Bg1, Bb1, Br2, Bg2, Bb2, . . . outputted by sampling circuits 20*a*, 20*b*, 20*c*, 20*d*, 20*e*, 20*f*, . . . will have video data on different positions shifted by one pixel from one to the next. Accordingly, pixel signals Sr1, Sg1, Sb1, Sr2, Sg2, Sb2, . . . provided for column-electrodes 2*r*1, 2*g*1, 2*b*1, 2*r*2, 2*g*2, 2*b*2, . . . by output buffer circuits 21*a*, 21*b*, 21*c*, 21*d*, 21*e*, 21*f*, . . . have video data on different positions shifted by one pixel, or by the length L from one to the next. Since the pixels on the row-electrode 1 which respectively receive the pixel signals Sr1, Sg1, Sb1, Sr2, Sg2, Sb2, . . . simultaneously, are arranged at intervals of the length L, any mismatch will not occur at all when composed picture is observed.

Nevertheless, since the above-described three-point successive sampling method uses the clock signal CKA periodically pulsing at intervals of one-dot term $\tau$ as shown in FIG. 6(102), the input clock frequency is rather high. Accordingly, if the frequency of the input clock is increased with the augment of the number of the horizontal pixels, the system could bring about unwanted radiation or induce errors in logical operations. Therefore, the three-point successive sampling method is pertinent to only use for driving a display device having a small number of horizontal pixels.

In contrast, in a case where a display device having a large number of horizontal pixels is to be driven, use is made of a sampling method termed as 'three-point simultaneous sampling' in which pixel signals Sr, Sg and Sb are sampled at the same timing from video signals VR, VG and VB, respectively. The period of the clock signal CKB used in this case is as long as three-dot term ($3\tau$), so that if the input clock frequency is increased with the augment of the number of the horizontal pixels, it is possible to avoid the occurrence of unwanted radiation as well as errors in logical operations.

Japanese Patent Application Laid-Open Hei 3 No.158895, for instance, presents a color matrix display device capable of effecting the three-point simultaneous sampling in order to solve the problems accompanied by the three-point successive sampling method.

The three-point simultaneous sampling method, however, exhibits another defect, namely unnaturalness in the picture. More specifically, despite that positions of neighboring three pixels 3R, 3G, 3B differs by the length L from one to the next, the three samplings are effected simultaneously. As a result, the sampled pixel signals Sr1, Sg1 and Sb1 will be formed from completely identical video information with the shift '0', thus presenting unnaturalness to the formed picture. To make matters worse, despite that the displaying position of the pixel 3B differs by only the length L from that of the adjoining pixel 3R', there is a $3\tau$-lag between the time at which signal sampling for the pixel 3B is made from the video signal VB and the time at which signal sampling for the pixel 3R' is made from the video signal VR. In other words, video data to be spaced three pixels away or shifted by 3L in length is displayed and observed side by side so that the discontinuity between the two will be inevitably notable.

Now, the three-point simultaneous sampling will be detailed with reference to the drawings. FIGS. 3 and 7 respectively show a block circuit diagram of a column-electrode driving circuit 8 and a timing chart used in the case. FIGS. 4 and 5 show a sampling circuit 20 and an output buffer circuit 21, respectively, to be used for those shown in FIG. 3. In FIG. 3, the same components as in described in FIG. 2 are denoted with the same reference numerals and detailed description for those is omitted.

In FIG. 3, terminal 9 is supplied with a start pulse SP shown in FIG. 7(101) and terminal 10 is supplied with a clock signal CKB pulsing periodically at intervals of three-dot term ($3\tau$) as shown in FIG. 7(102). A pulse width determining circuit 22' receives the start pulse SP to generate a pulse SPB having a predetermined pulse width shown in FIG. 7(103).

D-flip flops DB1, DB2, . . . sample pulses SPB, QB1, . . . , respectively when the clock signal CKB given to terminals CKs rises and generate pulses QB1, QB2, . . . as shown in FIGS. 7(105) and (106) each of which is delayed by $3\tau$ from the corresponding sampled signal. The pulse QB1 is given as sampling pulses Ar1, Ag1 and Ab1, respectively to three sample hold circuits 20*a*, 20*b* and 20*c* corresponding to three neighboring pixels. Similarly, the pulse QB2 is provided as sampling pulses Ar2, Ag2 and Ab2, respectively to three sample hold circuits 20*d*, 20*e* and 20*f* corresponding to three neighboring pixels. The subsequent pulses are provided in the same manner as above.

Accordingly, since all the three sampling pulses Ar1, Ag1 and Ab1 are synchronized with one another, pixel signals Br1, Bg1 and Bb1 respectively sampled by the sampling circuits 20*a*, 20*b* and 20*c* have data on the same video information. Therefore, despite that the pixel signals Sr1, Sg1 and Sb1 are dependent upon the completely identical video information, the displaying pixels 3R, 3G and 3B neighboring are positioned at intervals of the length L, so that the displayed picture will exhibit unnaturalness as stated above.

Moreover, there is a 3τ-lag between the timings of the sampling pulses Ab1 and Ar2, which yields a shift reduced to three pixels between the pixel signal Bb1 sampled by the sampling pulse Ab1 and the pixel signal Br2 sampled by the sampling pulse Ar2. Therefore, the pixel signals Sb1 and Sr2 supplied respectively to the neighboring pixels 3B and 3R' shown in FIG. 1 also includes a shift reduced to three pixels. This is equivalent to a 3L-distance. Accordingly, despite that the display state represented by the pixel signal Sr2 should be placed three pixels away from the display state represented by the pixel signal Sb1, the two pixels in practice are arranged side by side or with only one pixel length L apart, so that the discontinuity between the two will be notable giving unnaturalness to the picture.

Japanese Patent Application Laid-Open Hei 4 No.365288 has presented a sampling method of picture signals in which modification of the three-point successive sampling is made by varying the pulse duty factor of clock so as to realize a three close point sampling that provides similar effects to the simultaneous sampling method. This method, however, cannot completely attain the simultaneous sampling. Besides, since the pulse duty of the clock is varied, some troublesome treatments are required such as, for example, providing a filter in order to take a measure against noise radiation.

As described heretofore, it was necessary to determine which sampling should be made the three-point successive sampling or the three-point simultaneous sampling in the initial stage where the column-electrode driving circuit 8 was designed. Therefore, column-electrode driving circuits 8 were required to be produced individually depending upon a specific usage. As a result, the number of the production steps increases, causing increase in cost. Meanwhile, as the variety of utilities of the display devices is expanded, some users or utilities require relatively high horizontal resolution with a certain number of horizontal pixels on a display screen and some do not require such a high resolution with the same number of the pixels. In such cases, the users wished to select one sampling mode from the two, but it was not allowed in the prior art system. In one word, the apparatus could not be used in any sampling mode other than the mode set at shipping.

When the three-point successive sampling is effected, the clock signal CKA has to have a period of one-dot term τ as shown in FIG. 6(102). Therefore, if the frequency of the clock signal CKA is tried to be heightened in order to increase the number of horizontal pixels, unwanted radiation would occur or errors would be made in logic operations. For this reason, it is impossible to realize a high-resolution as long as a driving circuit based on the three-point successive sampling mode is used for a display panel having a large number of horizontal pixels.

A circuit arrangement of both the circuits shown in FIGS. 2 and 3 in parallel requires an extremely large area for the driving circuit, so that it is unfeasible to realize the system in practice.

SUMMARY OF THE INVENTION

The present invention has been achieved in order to solve the above problems, and it is therefore an object of the present invention to provide a driving circuit for a matrix-type color-display device which allows selection of modes of sampling data for three neighboring RGB pixels from the three-point successive sampling mode and the three-point simultaneous sampling mode.

In order to achieve the above object, a driving circuit of the present invention is to be used in a display device which includes: a display panel having row-electrodes and column-electrodes arranged matrix-wise and a number of three-neighboring pixel sets each presenting red, green and blue colors arranged so that the pixels occupy intersections between the row-electrodes and the column-electrodes; and holding means in which red, green and blue pixel signals are sampled during first, second and third sampling pulse terms, respectively from corresponding video signals made up of time-sequentially strung pixel signals each having one-dot term, and the driving circuit comprises:

means for generating a clock signal periodically pulsing at intervals of three-dot term;

means for generating a starting pulse;

means for successively generating, based on the clock pulse and the starting pulse, controlling pulses which are delayed by three-dot term from one to the next;

means for generating a mode signal which instructs any one of first and second modes;

timing pulse generating means which successively generates first, second and third timing pulses which are delayed by one-dot term from one to the next, if the mode signal indicates the first mode, and which successively generates first, second and third timing pulses which stay at high level at any time if the mode signal indicates the second mode; and means for generating the first, second and third sampling pulses by taking logical products of the first, second and third timing pulses with each of the controlling pulses which are commonly used.

As the driving circuit of the present invention is thus constructed, when it is operated in the first mode, the first, second and third timing pulses are delayed successively by one-dot term from one to the next. Accordingly, the first, second and third sampling pulses which are obtained by taking logical products of the above timing pulses with each of the control pulses are delayed successively by one-dot term from one to the next. Therefore, the timings at which the holding means samples each of pixel signals for R, G and B can be delayed by one-dot term successively from one to the next. At this time, the pulse term of the subsequent first sampling pulse can be delayed by one-dot term from the pulse term of the last third sampling pulse. Similarly, the following pulse terms of subsequently coming up sampling pulses can be delayed successively by one-dot term from one to the next (three-point successive sampling).

When the driving circuit is operated in the second mode, since all the first, second and third timing pulses are kept at high level at any time, the first, second and third sampling pulses which are obtained by taking logical products of the above timing pulses with each of the common control pulses yield pulses equal to the respective common control pulses. Therefore, the timings at which the holding means samples each of pixel signals for R, G and B can be made coincident. At this time, the common pulse term of the subsequent first, second and third sampling pulses can be delayed by three-dot term from the common pulse term of the last first, second and third sampling pulses. Similarly, the following common pulse terms of subsequently coming up three grouped sampling pulses can be delayed successively by three-dot term from one to the next (three-point simultaneous sampling).

DESCRIPTION OF THE PREFERRED EMBODIMENTS

Figure 1:
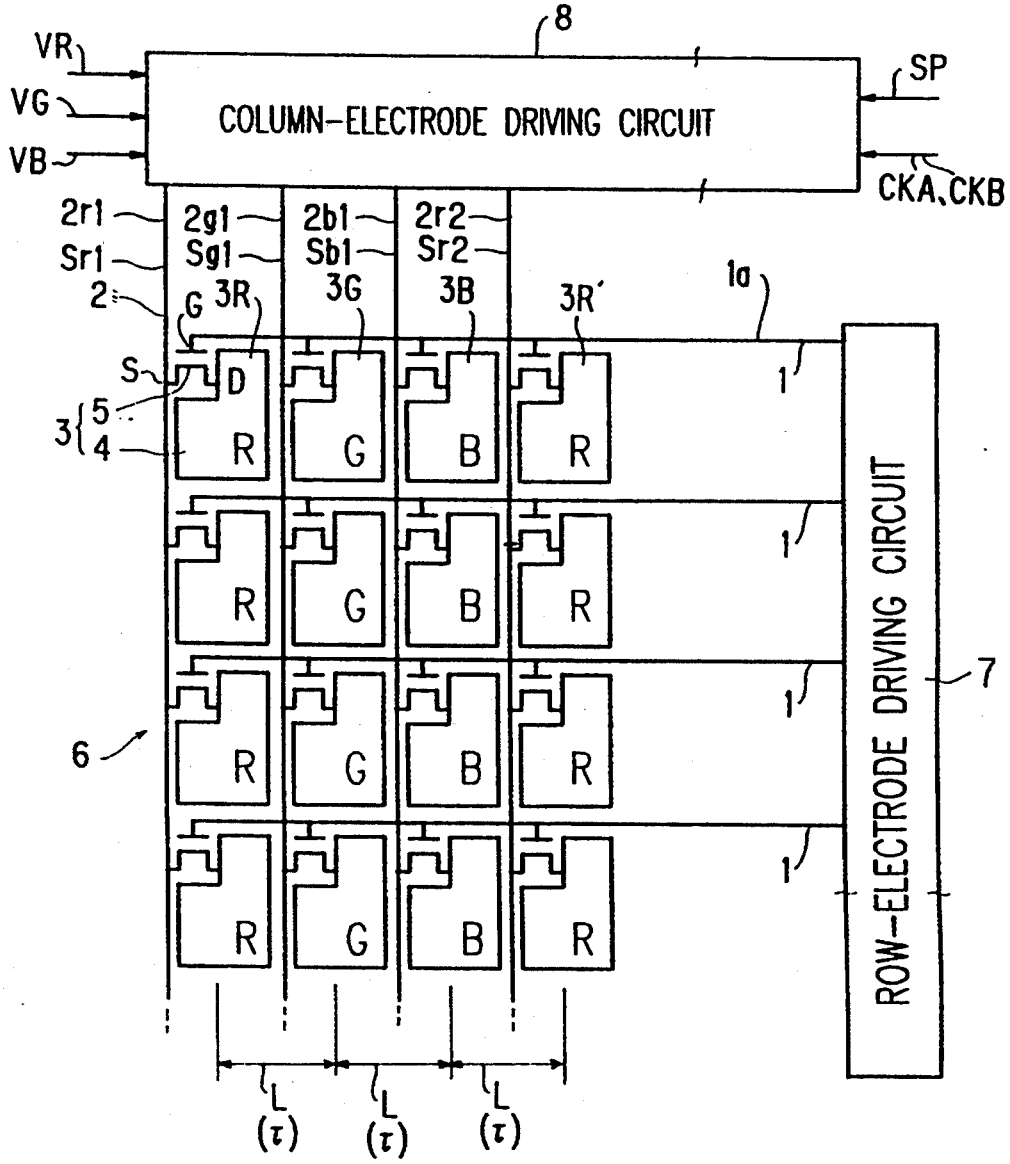
FIG. 1 is a block circuit diagram showing a conceptual basic structure of a TFT liquid crystal display device.
Figure 2:
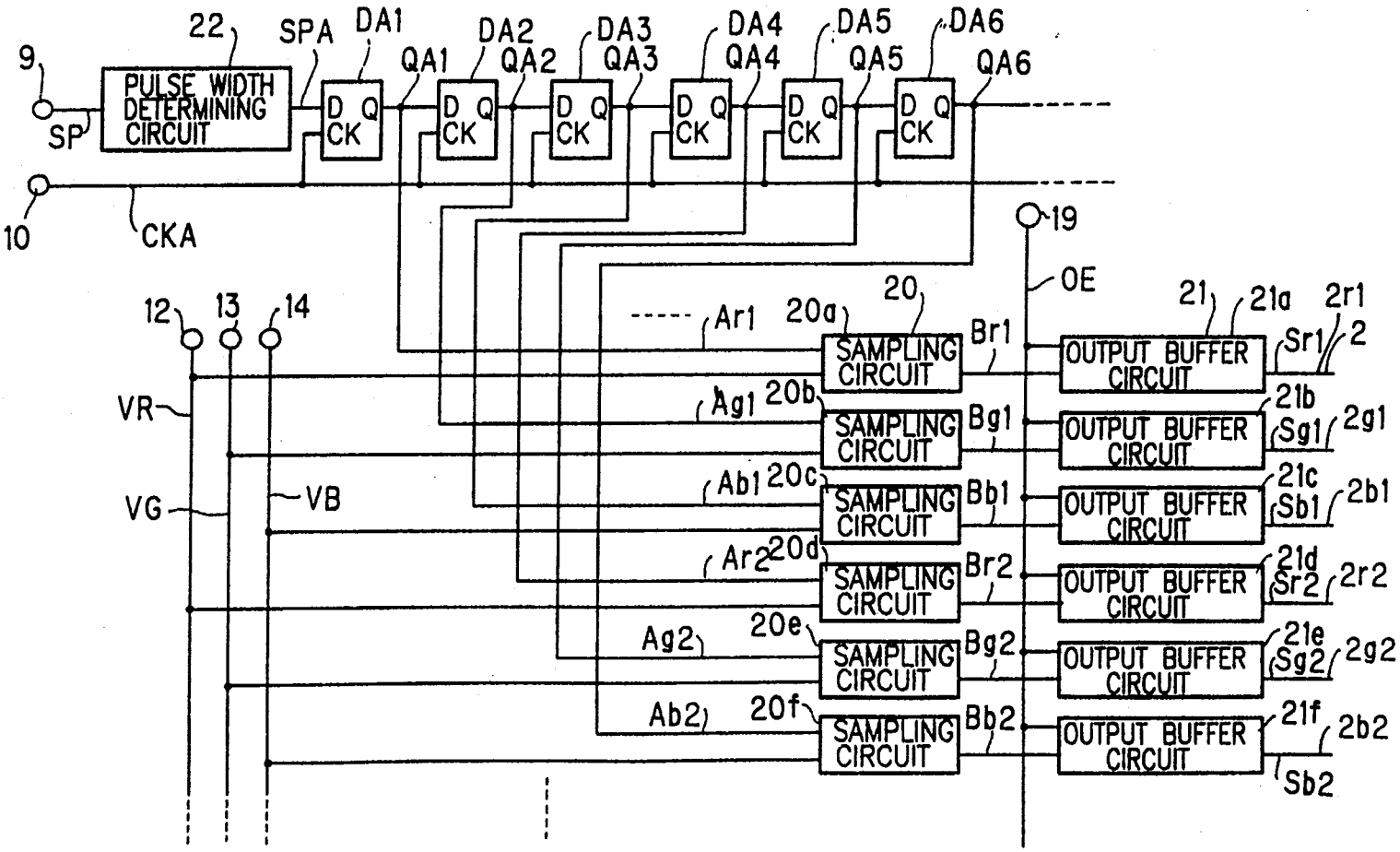
FIG. 2 PRIOR ART
FIG. 2 is a block circuit diagram of a column-electrode driving circuit which effects conventional three-point successive sampling.
Figure 3:
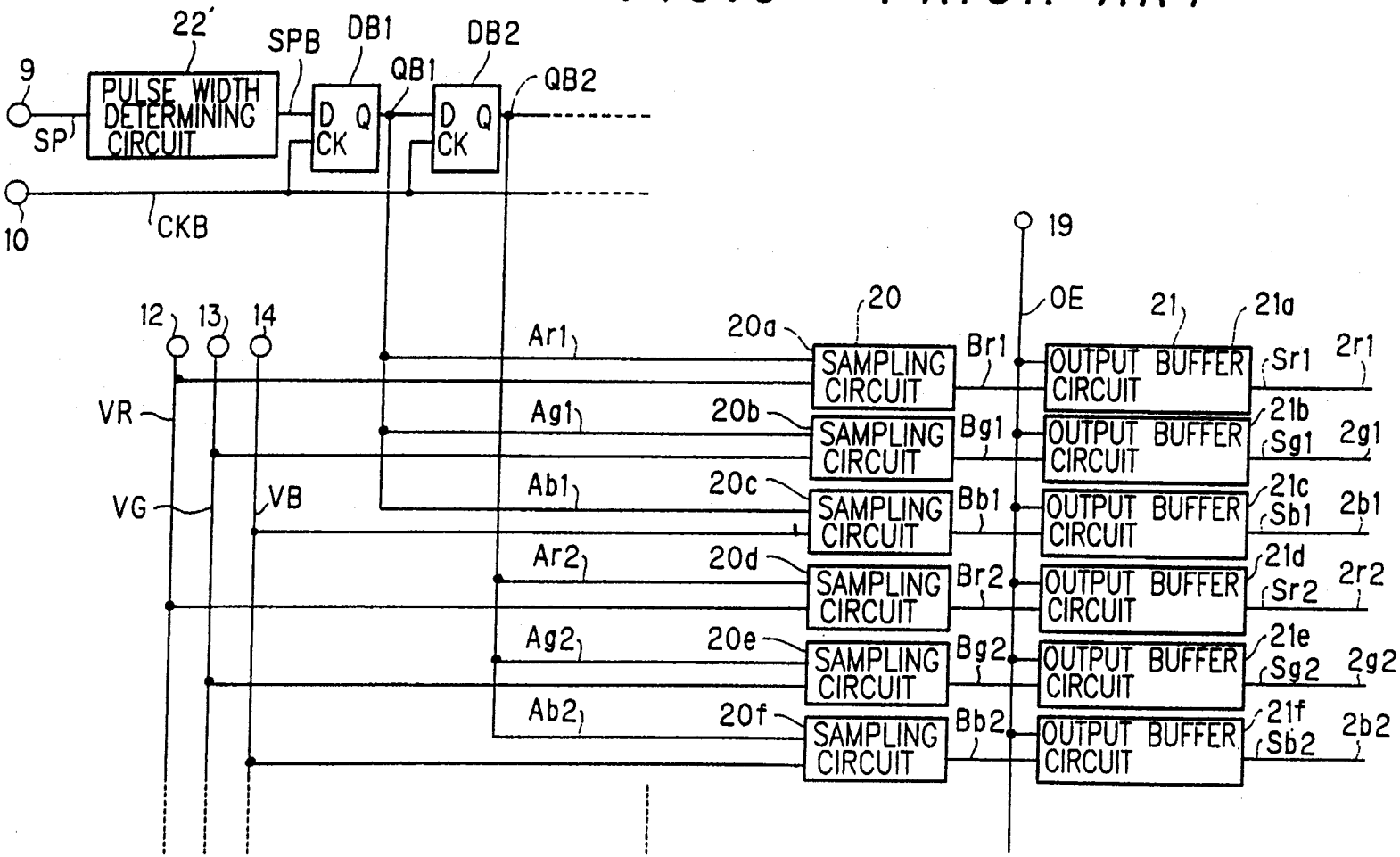
FIG. 3 PRIOR ART
FIG. 3 is a block circuit diagram of a column-electrode driving circuit which effects conventional three-point simultaneous sampling.
Figure 4:
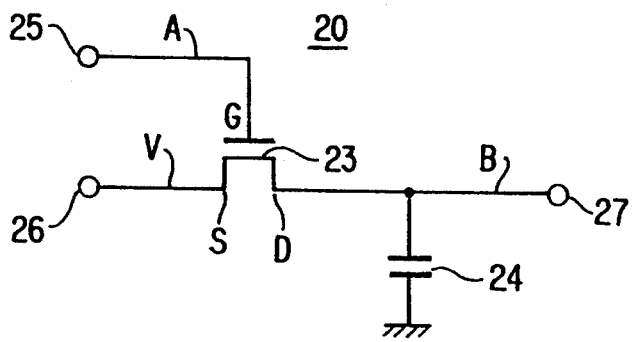
FIG. 4 PRIOR ART
FIG. 4 is a circuit diagram showing a sampling circuit used for circuits shown in FIGS. 2 and 3.
Figure 5:
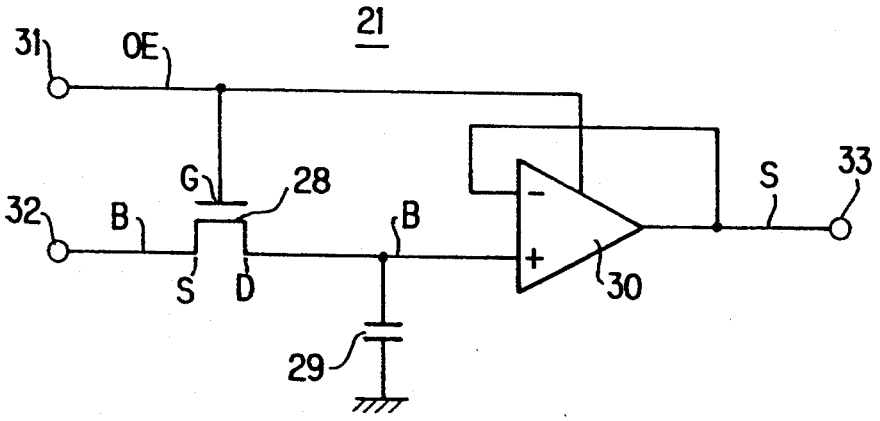
FIG. 5 PRIOR ART
FIG. 5 is a circuit diagram showing an output buffer circuit used for circuits shown in FIGS. 2 and 3.
Figure 6:
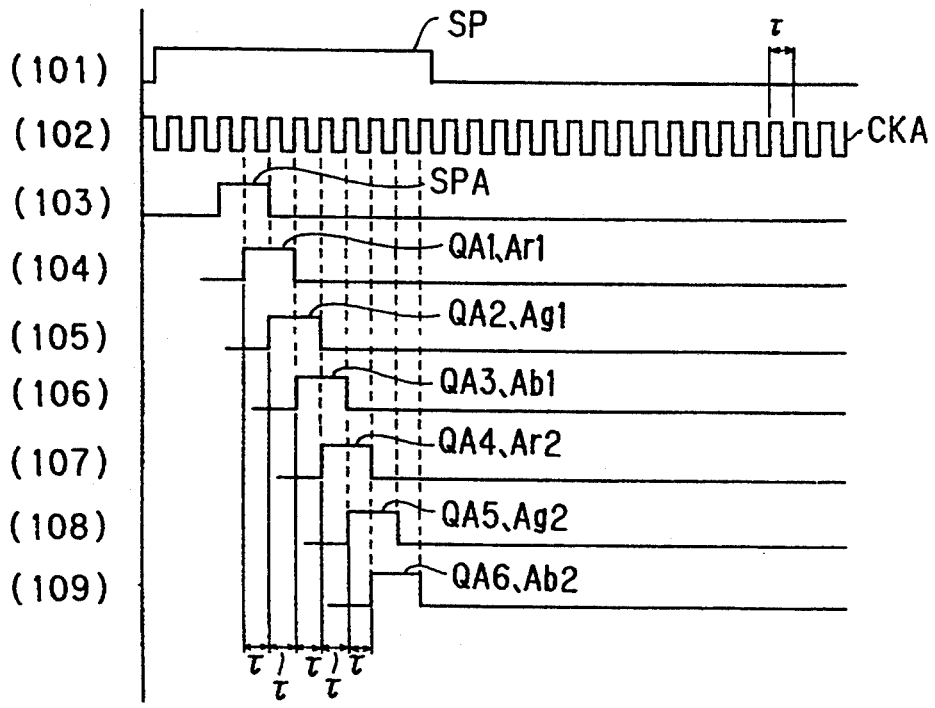
FIG. 6 PRIOR ART
FIG. 6 is a timing chart in a column-electrode driving circuit effecting typical conventional three-point successive sampling.
Figure 7:
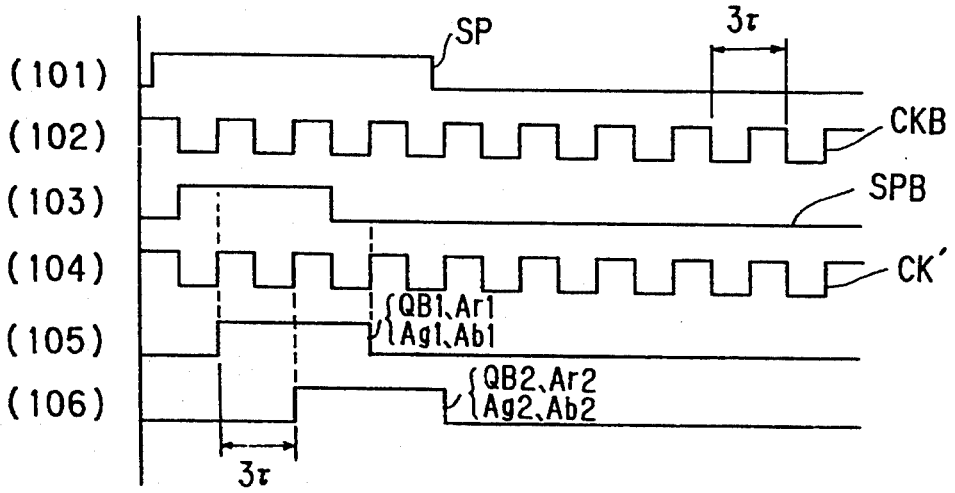
FIG. 7 PRIOR ART
FIG. 7 is a timing chart in a column-electrode driving circuit effecting typical conventional three-point simultaneous sampling.
Figure 8:
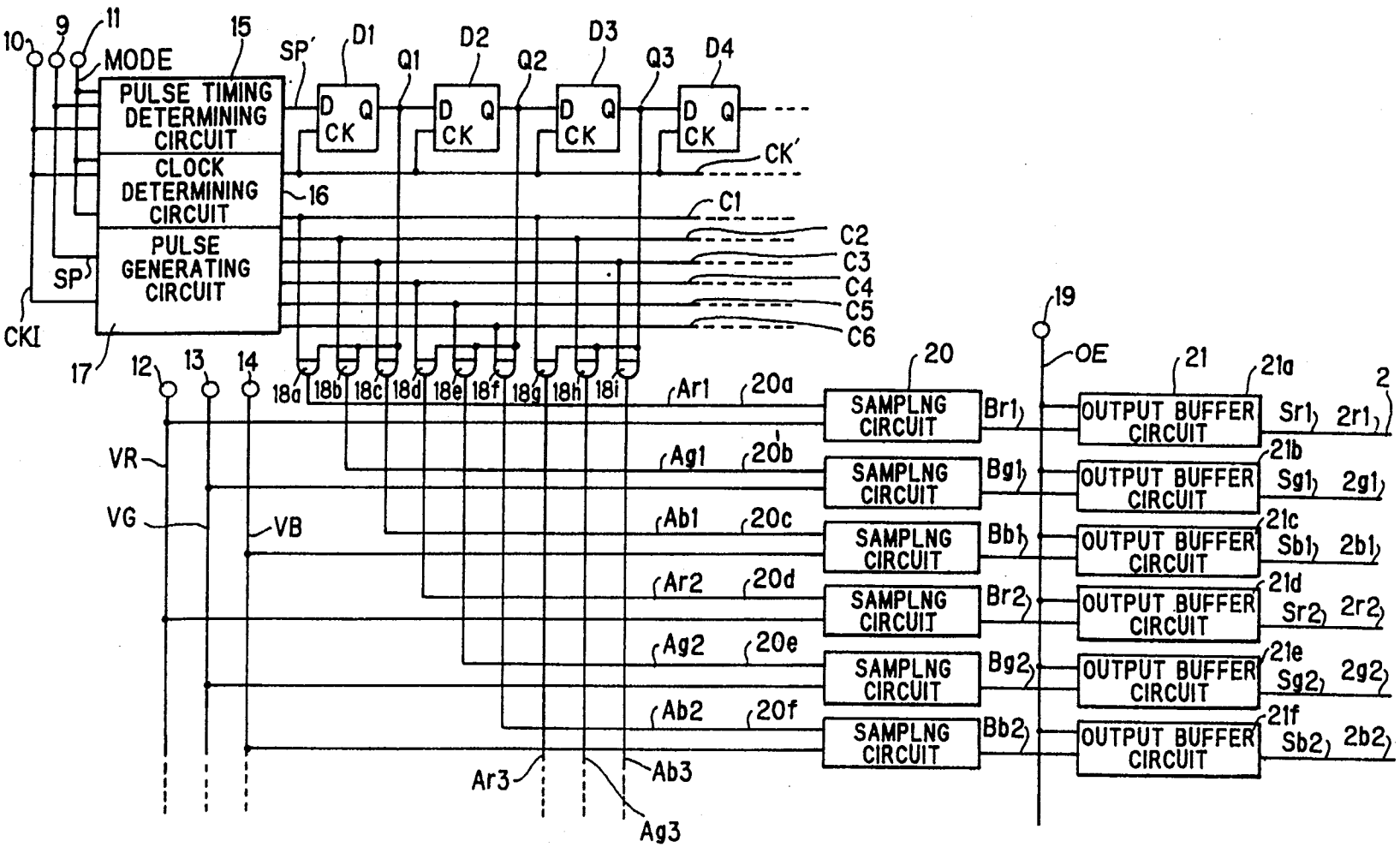
FIG. 8 is a block circuit diagram of a column-electrode driving circuit to which the present invention is applied.
Figure 9:
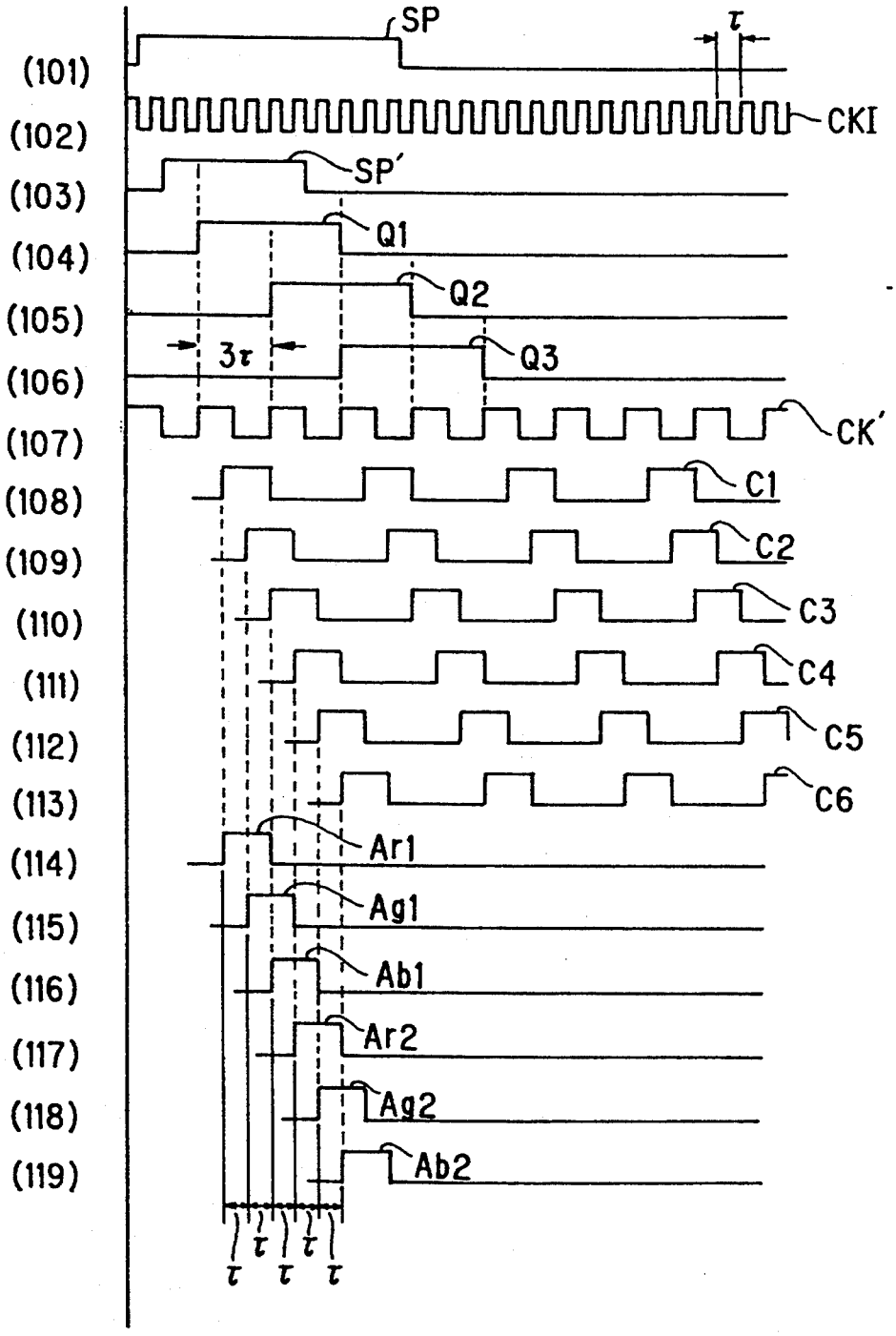
FIG. 9 is a timing chart where three-point successive sampling is effected in a column-electrode driving circuit to which the present invention is applied.
Figure 10:
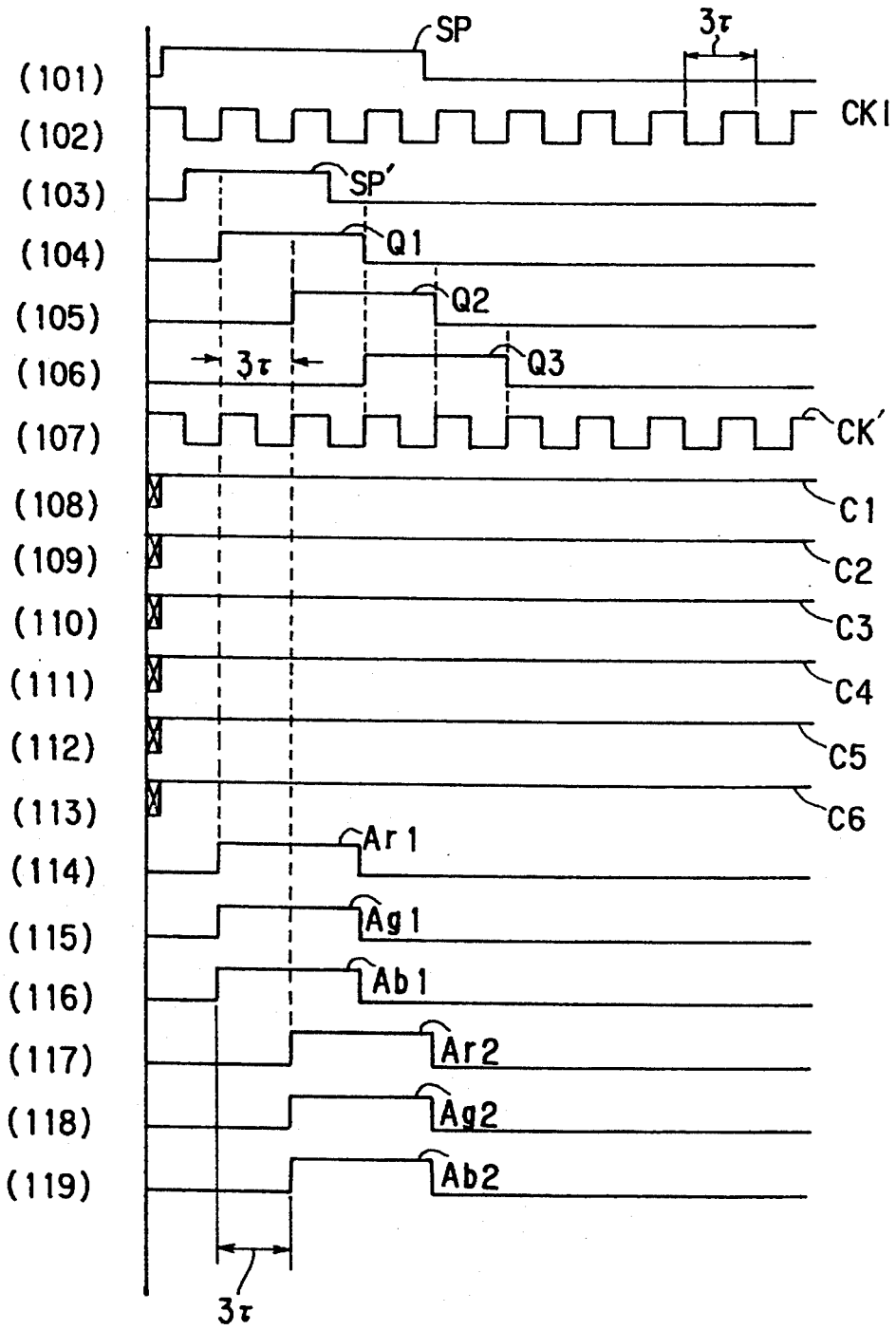
FIG. 10 is a timing chart where three-point simultaneous sampling is effected in a column-electrode driving circuit to which the present invention is applied.

FIG. 1 shows an example of a driving circuit for driving a TFT liquid crystal display device and is a block circuit diagram of a basic structure showing a driving circuit for a matrix-type color display device to which the present invention is applied. An embodiment of the present invention will be now described based on the figure. FIG. 8 shows a block circuit diagram of a column-electrode driving circuit 8 (FIG. 1) for effecting the present invention. FIG. 9 shows a timing chart where three-point successive sampling is effected by the driving circuit shown in FIG. 8 whereas FIG. 10 is a timing chart where three-point simultaneous sampling is effected by the driving circuit shown in FIG. 8. In FIGS. 8, 9 and 10, the same components shown in FIGS. 1, 2 3, 6 and 7 are denoted by the same reference numerals and detailed description of those will be omitted.

The circuit shown in FIG. 8 includes a pulse timing determining circuit 15, a clock determining circuit 16 and a pulse generating circuit 17. All these circuits determine, based on a mode signal MODE supplied via a terminal 11, which operation mode is selected three-point successive sampling or three-point simultaneous sampling. In the case where the three-point successive sampling mode is selected as the operation mode, starting pulse SP shown in FIG. 9(101) and clock signal CKI periodically pulsing at intervals of one-dot term $\tau$ shown in FIG. 9(102) are supplied to terminals 9 and 10.

The pulse timing determining circuit 15 receives start pulse SP to generate a pulse SP′ having a predetermined pulse width as shown in FIG. 9(103). The thus generated pulse SP′ is provided to an input terminal D of D-flip flop D1. The clock determining circuit 16 converts the clock signal CKI to generate a clock signal CK′ having a period of three-dot term $3\tau$ shown in FIG. 9(107) to supply the signal to terminals CKs of D-flip flow flops D1, D2, D3, . . . .

Thus, in the present invention, when the driving circuit effects three-point successive sampling, the driving circuit is operated based on the clock signal CK′ having a period of three-dot term $3\tau$, in place of the clock signal CKI having a period of one-dot term $\tau$. Therefore, the input clock frequency used in the system can be reduced to low level, so that it is possible to avoid unwanted radiation and misoperation in logical operations. In addition, the reduction of the input clock frequency allows the input clock frequency to increase (or one-dot term value $\tau$ to decrease) in a range within which neither unwanted radiation nor logic misoperation arises, whereby it is possible to increase the number of horizontal pixels on a display panel 6 driven by the system.

The pulse Generating circuit 17, based on the starting pulse SP and clock signal CKI, Generates pulses C1, C2, C3, C4, C5 and C6 respectively shown in FIGS. 9(108), (109), (110), (111), (112) and (113). The positions or terms of the Generated pulses are shifted from one to the next by $\tau$. The pulses C1, C2, C3, C4, C5 and C6 are supplied in this order cyclically to AND circuits **18*a*, 18*b*, 18*c*, 18*d*, 18*e*, 18*f*, 18*g*, 18*h*, 18*i***, . . . .

D-flip flop D1 samples the pulse SP′ Given to the input terminal D thereof when the clock signal CK′ provided to the terminal CK rises, to thereby Generate a pulse Q1 which is time-delayed relative to the pulse SP′ as shown in FIG. 9(104). The thus generated pulse Q1 is provided to input terminals of AND circuits **18*a*, 18*b* and 18*c* as well as to an input terminal D of a D-flip flop D2. The D-flip flop D2 in turn samples the pulse Q1 given to the input terminal D thereof when the clock signal CK′ provided to the terminal CK rises, to thereby generate a pulse Q2 which is time-delayed by three-dot term $3\tau$ relative to the pulse Q1 as shown in FIG. 9(105). The thus generated pulse Q2 is provided to input terminals of AND circuits 18*d*, 18*e* and 18*f* as well as to an input terminal D of a D-flip flop D3. The D-flip flop D3 in turn samples the pulse Q2 given to the input terminal D thereof when the clock signal CK′ provided to the terminal CK rises, to thereby generate a pulse Q3 which is time-delayed by three-dot term $3\tau$ relative to the pulse Q2 as shown in FIG. 9(106). The thus generated pulse Q3 is provided to input terminals of AND circuits 18*g*, 18*h* and 18*i* as well as to an input terminal D of a D-flip flop D4. The following steps including D-flip flops D4**, . . . operate in the same manner.

AND circuits **18*a*, 18*b*, 18*c*, 18*d*, 18*e* and 18*f* effect respective logical product operations between pulses C1 and Q1, pulses C2 and Q1, pulses C3 and Q1, pulses C4 and Q2, pulses C5 and Q2, pulses C6 and Q2, pulses C1 and Q3, pulses C2 and Q3, and pulses C3 and Q3, to produce sampling pulses Ar1, Ag1, Ab1, Ar2, Ag2, Ab2 as shown in FIGS. 9(114), (115), (116), (117), (118) and (119). As shown in the figures, the pulse terms of these generated signals are delayed from one to the next by $\tau$. The thus generated sampling pulses are respectively provided to sampling circuits 20*a*, 20*b*, 20*c*, 20*d*, 20*e* and 20*f***.

The subsequent AND circuits **18*g*, 18*h*, 18*i*, also make logical products between pulses C1 and Q1, pulses C2** and Q1, pulses C3 and Q1, to thereby create sampling pulses Ar3, Ag3, Ab3, . . . , which are also delayed from one to the next by $\tau$. The following AND circuits also operate in the same manner. In the above operation, pulses C1 to C6 are applied cyclically and the term of the pulse C1 used next to the pulse C6 also shifts by $\tau$ relative to the term of the pulse C6. Therefore, the sampling pulse Ar3 generated by the second-round pulse C1, for example, is delayed by $\tau$ relative to the aforementioned sampling pulse Ab2 generated by the first-round pulse C6. To sum up, the pulse terms of the sampling pulses Ar1, Ag1, Ab1, Ar2, Ag2, Ab2, Ar3, Ag3, Ab3, . . . , are delayed successively by one-dot term $\tau$ from one to the next.

Since, for example, the pulse terms of the sampling pulses Ar1, Ag1 and Ab1 are shifted by $\tau$ from one to the next, the video data of pixel signals Br1, Bg1 and Bb1 picked up from video signals VR, VG and VB by the sampling circuits 20*a*, 20*b* and 20*c* are delayed by one pixel from one to the next. Accordingly, in the same manner, the video data of pixel signals Br1, Bg1, Bb1, Br2, Bg2, Bb2, . . . , held by the sampling circuits 20*a*, 20*b*, 20*c*, 20*d*, 20*e* and 20*f* are also delayed by one pixel from one to the next.

As a result, the video data of the pixel signals Sr1, Sg1, Sb1, Sr2, Sg2, Sb2, . . . , supplied to column-electrodes 2r1, 2g1, 2b1, 2r2, 2g2, 2b2 by output buffer circuits 21*a*, 21*b*, 21*c*, 21*d*, 21*e*, 21*f*, . . . , are shifted by one pixel or by the length L from one to the next. Therefore, in a case where these pixel signals Sr1, Sg1, Sb1, Sr2, Sg2, Sb2, . . . are simultaneously taken in so that all the pixels on a row-electrode 1 reproduce a picture, the picture is free from mismatching when observed since the real positions of the corresponding pixels on the screen are also shifted by the length L from one to the next. This feature is peculiar to the three-point successive sampling mode.

In a case where the operation is effected in three-point simultaneous sampling mode, terminals 9 and 10 are supplied with start pulse SP and clock pulse CKI having a period of three-dot term $3\tau$, respectively shown in FIGS. 10(101) and (102). The pulse timing determining circuit 15 receives the starting pulse SP to produce a pulse SP' having a predetermined pulse width as shown in FIG. 10(103). The thus generated pulse SP' is supplied to the terminal D of the D-flip flop D1.

The clock determining circuit 16 converts the clock signal CKI to generate a clock signal CK' shown in FIG. 10(107) to supply the signal to terminals CKs of D-flip flow flops D1, D2, D3, . . . . The pulse generating circuit 17, based on the starting pulse SP and clock signal CKI, generates pulses C1, C2, C3, C4, C5 and C6 which are at "high" level at any time. These pulses are shown in FIGS. 10(108), (109), (110), (111), (112) and (113), respectively. The pulses C1, C2, C3, C4, C5, C6, C1, C2, C3, are supplied in this order cyclically to AND circuits 18*a*, 18*b*, 18*c*, 18*d*, 18*e*, 18*f*, 18*g*, 18*h*, 18*i*, . . . , respectively.

D-flip flop D1 samples the pulse SP' given to the input terminal D thereof when the clock signal CK' provided to the terminal CK rises, to thereby generate a pulse Q1 which is time-delayed relative to the pulse SP' as shown in FIG. 10(104). The thus generated pulse Q1 is provided to input terminals of AND circuits 18*a*, 18*b* and 18*c* as well as to the input terminal D of the D-flip flop D2. The D-flip flop D2 in turn samples the pulse Q1 given to the input terminal D thereof when the clock signal CK' provided to the terminal CK rises, to thereby generate a pulse Q2 which is time-delayed by three-dot term $3\tau$ relative to the pulse Q1 as shown in FIG. 10(105). The thus generated pulse Q2 is provided to input terminals of AND circuits 18*d*, 18*e* and 18*f* as well as to the input terminal D of the D-flip flop D3. The D-flip flop D3 in turn samples the pulse Q2 given to the input terminal D thereof when the clock signal CK' provided to the terminal CK rises, to thereby generate a pulse Q3 which is time-delayed by three-dot term $3\tau$ relative to the pulse Q2 as shown in FIG. 10(106). The thus generated pulse Q3 is provided to input terminals of AND circuits 18*g*, 18*h* and 18*i* as well as to the input terminal D of the D-flip flop D4. The following steps including D-flip flops D4, . . . operate in the same manner.

AND circuits 18*a*, 18*b* and 18*c* effect respective logical product operations between pulses C1 and Q1, pulses C2 and Q1 and pulses C3 and Q1 to produce sampling pulses Ar1, Ag1, Ab1 as shown in FIGS. 10(114), (115) and (116). As shown in the figures, these sampling pulses generated are completely in phase with one another and respectively provided to sampling circuits 20*a*, 20*b* and 20*c*. AND circuits 18*d*, 18*e* and 18*f* effect respective logical product operations between pulses C4 and Q2, pulses C5 and Q2 and pulses C6 and Q2 to produce sampling pulses Ar2, Ag2, Ab2 as shown in FIGS. 10(117), (118) and (119). As shown in the figures, the sampling pulses generated are completely in phase with one another and respectively provided to sampling circuits 20*d*, 20*e* and 20*f*.

A three-dot term lag ($3\tau$) is created between the common pulse term of the sampling pulses Ar1, Ag1 and Ab1 and the common pulse term of the sampling pulses Ar2, Ag2 and Ab2. The subsequent AND circuits 18*g*, 18*h* and 18*i* effect respective logical product operations between pulses C1 and Q1, pulses C2 and Q1 and pulses C3 and Q1 to produce sampling pulses Ar3, Ag3 and Ab3 which all have a common pulse term. Also in this case, a three-dot term lag ($3\tau$) is created between the common pulse term of the sampling pulses Ar2, Ag2 and Ab2 and the common pulse term of the sampling pulses Ar3, Ag3 and Ab3. Similarly, the following three-consecutive pulse sets have their own common pulse terms, and a three-consecutive pulse set having a certain common pulse term will be followed after three-dot term lag ($3\tau$) by the next three consecutive pulse set.

Since sampling pulses Ar1, Ag1 and Ab1, for example, have a common pulse term, the pixel signals Br1, Bg1 and Bb1 sampled respectively by the sampling circuits 20*a*, 20*b* and 20*c* ought to have data on identical video information. As a result, the pixel signals Sr1, Sg1 and Sb1 to be supplied to the neighboring pixels 3R, 3G and 3B will have identical video information. This means that the positional shift from one another is reduced to '0'. In practice, however, the displayed positions of the pixels 3R, 3G and 3B are shifted by the length L from one to the next, so that an unnatural video picture will be obtained which is peculiar to the three-point simultaneous sampling mode.

Further, since the sampling pulse Ar2 has a pulse term shifted by a three-dot term ($3\tau$) from that of the sampling pulse Ab1, the pixel signal Br2 sampled by the sampling circuit 20*d* at the timing of the sampling pulse Ar2 will be shifted by three-pixel length from the pixel signal Bb1 sampled by the sampling circuit 20*c* at the timing of the sampling pulse Ab1. As a result, the pixel signals Sb1 and Sr2 supplied respectively to the neighboring pixels 3B and 3R′ shown in FIG. 1 also includes a shift reduced to three pixels. This is equivalent in length to a distance of 3L. Accordingly, despite that the display state represented by the pixel signal Sr2 should be placed three pixels away from the display state represented by the pixel signal Sb1, the two pixels 3B and 3R′ in practice are arranged side by side or with only one pixel length L apart. Therefore, an unnatural video picture is obtained which is peculiar to the three-point simultaneous sampling.

As described heretofore, in the column-electrode driving circuit 8 shown in FIG. 8 for realizing the present invention, two operation modes, e.g. , three-point successive sampling mode and three-point simultaneous sampling mode can be used properly by the mode signal MODE which is selected by the user.

It should be noted that, although the embodiment of the present invention has been described by taking an example of a TFT liquid crystal display device, the driving circuit for the display device to which the present invention is applied can be operated in the same way by any other matrix-type display devices.

As is apparent from the foregoing description, according to the present invention, since the operation mode of the system can be selected from the three-point successive sampling mode and the three-point simultaneous sampling mode by the outside means, it is possible to optionally select a sampling mode depending upon the using way and the utility intended by the user.

Generally, the three-point successive sampling mode is used in the case where the number of horizontal pixels is relatively small whereas the three-point simultaneous sampling mode is used in the case where the number of horizontal pixels is relatively large. With the system of the present invention, however, it is also possible to select other two combinations exactly opposite to the above. Specifically, the three-point simultaneous sampling mode may be selected when the number of horizontal pixels is relatively small and the three-point successive sampling mode may be used when the number of horizontal pixels is relatively large. Therefore, it is possible to optionally select any one of the four combinations, so that the manufacturing procedures can be reduced and therefore the cost of the manufacture can be diminished markedly as compared to the prior art in which dedicated driving circuits are provided separately for the individual combinations.

In addition, it is possible to remarkably reduce the occupying area of the driving circuit as compared to that in the prior art system which merely includes the two driving circuits operated in different sampling modes.

Moreover, the driving circuit is operated based on a clock signal having a period of three-dot term $3\tau$ in either sampling mode, it is possible to limit the input clock frequency in the display device to low level and therefore it is possible to prevent the occurrence of unwanted radiation. This feature allows the driving circuit to be applied to the display devices such as for the television receivers and the like, so that the utility can be generalized.

Particularly, the clock frequency can be reduced to one-third of that in the prior art. This feature makes it possible to widen the range of the clock frequency within which the driving circuit is operated without unwanted radiation. In other word, the one-dot term $\tau$ can be reduced. As a result, the number of horizontal pixels can be increased, thus realizing an improved resolution.

What is claimed is:

1. A driving circuit for use in a display device wherein said display device includes: a display panel having row-electrodes and column-electrodes arranged matrix-wise and a number of three-neighboring pixel sets each presenting red, green and blue colors arranged so that the pixels occupy intersections between the row-electrodes and the column-electrodes; and holding means in which red, green and blue pixel signals are sampled during first, second and third sampling pulse terms, respectively from corresponding video signals made up of time-sequentially strung pixel signals each having one-dot term, said driving circuit comprising:

means for generating a clock signal periodically pulsing at intervals of three-dot term;

means for generating a starting pulse;

means for successively generating, based on said clock pulse and said starting pulse, controlling pulses which are delayed by three-dot term from one to the next;

means for generating a mode signal which instructs any one of first and second modes;

timing pulse generating means which successively generates first, second and third timing pulses which are delayed by one-dot term from one to the next, if said mode signal indicates the first mode, and which successively generates first, second and third timing pulses which stay at high level at any time if said mode signal indicates the second mode; and means for generating said first, second and third sampling pulses by taking logical products of said first, second and third timing pulses with each of said controlling pulses which are commonly used.

* * * * *